US007513082B2

(12) United States Patent
Johnson

(10) Patent No.: US 7,513,082 B2
(45) Date of Patent: Apr. 7, 2009

(54) SOUND REDUCING SYSTEM

(76) Inventor: Lahnie Johnson, 4216 E. Busch Blvd., Tampa, FL (US) 33617

( * ) Notice: Subject to any disclaimer, the term of this patent is extended or adjusted under 35 U.S.C. 154(b) by 598 days.

(21) Appl. No.: 11/054,005

(22) Filed: Feb. 8, 2005

(65) Prior Publication Data

US 2005/0188626 A1 Sep. 1, 2005

Related U.S. Application Data

(60) Provisional application No. 60/542,900, filed on Feb. 9, 2004.

(51) Int. Cl.
*E04B 1/82* (2006.01)
*E04C 2/34* (2006.01)

(52) U.S. Cl. ..... 52/144; 52/241; 52/481.1

(58) Field of Classification Search ..... 52/481.1, 52/481.2, 144, 145, 241, 794.1; 181/284, 181/290, 291
See application file for complete search history.

(56) References Cited

U.S. PATENT DOCUMENTS 1,833,174 A * 11/1931 Norris ..... 52/731.7
2,115,936 A * 5/1938 Sterns ..... 52/601
2,350,093 A * 5/1944 Braloff ..... 52/241
2,495,636 A 1/1950 Hoeltzel et al.
2,497,912 A 2/1950 Rees
2,553,363 A 5/1951 Droeger
2,694,025 A 11/1954 Slayter et al.
2,923,372 A 2/1960 Maccaferri
2,958,982 A * 11/1960 Baker ..... 52/241
3,001,615 A * 9/1961 Ries ..... 403/230
3,136,397 A 6/1964 Eckel
3,305,993 A * 2/1967 Nelsson ..... 52/481.1
3,333,390 A * 8/1967 Banning ..... 52/731.9
3,609,933 A * 10/1971 Martin et al. ..... 52/461
3,852,935 A * 12/1974 Jones ..... 52/731.1
3,949,827 A 4/1976 Witherspoon
3,950,912 A * 4/1976 Lundberg et al. ..... 52/733.2
3,967,693 A 7/1976 Okawa
4,018,020 A * 4/1977 Sauer et al. ..... 52/241
4,047,355 A * 9/1977 Knorr ..... 52/733.2
4,113,053 A 9/1978 Matsumoto et al.
4,160,491 A 7/1979 Matsumoto et al.
4,207,964 A 6/1980 Taguchi
4,248,325 A 2/1981 Georgopoulos
4,301,890 A * 11/1981 Zalas ..... 181/286
4,306,631 A 12/1981 Reusser
4,313,524 A * 2/1982 Rose ..... 181/291
4,324,082 A * 4/1982 Rutkowski et al. ..... 52/481.1
4,402,384 A 9/1983 Smith et al.

(Continued)

*Primary Examiner*—Robert J Canfield
*Assistant Examiner*—Brent W Herring
(74) *Attorney, Agent, or Firm*—Frijout, Rust & Pyle P.A.

(57) ABSTRACT

A system is disclosed for reducing the transmission of acoustical energy between a first and second wall surface of a wall comprising a first and a second beam for supporting a sound panel. Each of the first and second beams comprises first and second flanges interconnected by an inner connector with a fold defined in the inner connector for reducing the transmission of acoustical energy between the first and second flange. The fold cooperates with one of the flanges for defining a pocket for receiving an edge of a sound panel. The first and second flange support the first and second wall surface of the wall with the sound panel.

10 Claims, 8 Drawing Sheets

U.S. PATENT DOCUMENTS 4,435,936 A * 3/1984 Rutkowski ..... 52/481.1
4,443,991 A * 4/1984 Mieyal ..... 52/586.2
4,496,024 A * 1/1985 Wolf et al. ..... 181/292
4,553,631 A * 11/1985 Panza ..... 181/291
4,567,699 A * 2/1986 McClellan ..... 52/127.7
4,605,090 A 8/1986 Melfi
4,607,466 A 8/1986 Allred
4,805,734 A 2/1989 Mast
4,834,213 A 5/1989 Yamamoto et al.
5,092,100 A * 3/1992 Lambert et al. ..... 52/774
5,217,771 A 6/1993 Schmanski et al.
5,272,284 A 12/1993 Schmanski et al.
5,459,291 A * 10/1995 Haines et al. ..... 181/286
5,787,651 A * 8/1998 Horn et al. ..... 52/144
5,824,973 A * 10/1998 Haines et al. ..... 181/286
6,061,985 A * 5/2000 Kraus et al. ..... 52/232
6,345,688 B1 * 2/2002 Veen et al. ..... 181/290
6,381,916 B1 * 5/2002 Maisch et al. ..... 52/736.1
7,063,184 B1 * 6/2006 Johnson ..... 181/290
7,178,304 B2 * 2/2007 Brady ..... 52/653.1
7,308,778 B2 * 12/2007 Nanayakkara ..... 52/481.1
2004/0074200 A1 * 4/2004 Attalla ..... 52/731.1
2004/0131836 A1 * 7/2004 Thompson ..... 428/304.4
2004/0231914 A1 * 11/2004 Thompson et al. ..... 181/284
2004/0231915 A1 * 11/2004 Thompson et al. ..... 181/290
2005/0217932 A1 * 10/2005 Woodman et al. ..... 181/290
2006/0118355 A1 * 6/2006 Blomeling et al. ..... 181/286
2006/0237130 A1 * 10/2006 Thompson ..... 156/273.3
2007/0011971 A1 * 1/2007 Sitkiewicz ..... 52/481.1
2007/0125026 A1 * 6/2007 Frobosilo ..... 52/481.1
2008/0073146 A1 * 3/2008 Thompson et al. ..... 181/291

* cited by examiner

SOUND REDUCING SYSTEM

CROSS-REFERENCE TO RELATED APPLICATIONS

This application claims benefit of U.S. Patent Provisional application Ser. No. 60/542,900 filed Feb. 9, 2004. All subject matter set forth in provisional application Ser. No. 60/542,900 is hereby incorporated by reference into the present application as if fully set forth herein.

BACKGROUND OF THE INVENTION

1. Field of the Invention

This invention relates to sound transmission and more particularly to an improved system for reducing sound transmission between adjacent volumes.

2. Background of the Invention

The prior art has developed various devices and methods for reducing the transmission of acoustical energy through a wall between adjacent volumes. Many different types of wall and sound panels have been used by the prior art to reduce the transmission of acoustical energy. Acoustical panels have been well-known in the art for reflecting, absorbing and/or dissipating acoustic energy to prevent the acoustic energy from transmitting between adjacent volumes.

It is well-known that a solid material transmits acoustic energy in a very efficient manner. A typical interior wall is formed by a plurality of vertically extending supporting beams with a first and a second wall surface mounted to opposed sides of the vertically extending supporting beams. Acoustical energy impinging on the first wall surface is transmitted by the vertically extending supporting beams to the second wall surface.

It is also well-known in the prior art that an increase in the mass of the first and second wall surface will reduce the transmission of acoustical energy between the first and the second wall surface. This reduction in the transmission of acoustical energy is the due to the fact that a given amount of acoustic energy will produce less vibration on a massive wall surface relative to a less massive wall surface.

Others in the prior art realize that acoustic energy may be transmitted through the mountings used to mount the sound panels to a structure. Some in the prior art utilized plural spaced apart walls for reducing the transmission between adjacent volumes. The plural walls are spaced apart thereby eliminating the possibility of the vibration of one of the plural walls affecting the vibration of the second of the plural walls.

Some in the prior art have utilized various devices and means for reducing the transmission of acoustic energy through the between adjacent volumes. The following U.S. patents are representative of some of the prior art to provide sound panels with reduced transmission of acoustic energy therethrough.

U.S. Pat. No. 2,495,636 to Hoeltzel et al. discloses a unit comprising a layer of loosely matted mass of fibrous material. A substantially impervious preformed film of thermoplastic synthetic resin material is integralized with the fibers in one face of the loosely matted material. A fabric covering on the other face of the loosely matted layer is enfolded and is secured about the edges of the mass and the film. The mass, film and fabric are in the form of the sound proof flexible panel adapted to cover and soundproof a section of a wall.

U.S. Pat. No. 2,497,912 to Rees discloses an acoustic construction for the walls and ceilings of an enclosure comprising a sound absorbing layer overlying the wall and formed by a plurality of rectangular tiles of fibrous material arranged in a plane. The edges of each of the tiles are contiguous to and slightly spaced from the edges of adjoining tiles. A renewable facing for the sound absorbing layer includes a plurality of thin sheets of porous material individual to the tiles. Each of the sheets having tabs at its edges integral with the sheets and resiliently held in place between adjacent edges of the tiles to hold the sheets in place over the face of the tiles.

U.S. Pat. No. 2,553,363 to Droeger discloses a non-combustible wall or ceiling of a plurality of parallel, latterly spaced, non-combustible primary furring anchored thereon. Sound absorbent pads are arranged between adjacent pairs of furrings. A plurality of spaced, non-combustible secondary furring extend transversely across the primary furring and are secured thereto. Each of the secondary furrings comprise a portion lying in a plane parallel with the wall or ceiling and bridging between primary furring and provided with a multiplicity of perforations adapted to threadably receive threaded shanks of screws. A multi-perforate finish sheath overlies the aforesaid parts.

U.S. Pat. No. 2,694,025 to Slayter et al. discloses a structural board comprising a core of glass fibers bonded into a porous self-sufficient layer. A layer of substantially inorganic cementitious material is integrated with at least one of the faces of the core. The cementitious layer is formed of a composition consisting essentially of an amide-aldehyde resin selected from the group consisting of urea formaldehyde and melamine formaldehyde and gypsum cement.

U.S. Pat. No. 2,923,372 to Maccaferri discloses an all plastic acoustic tile formed of a molded plastic material comprising a plate-like body having a rearwardly extending edges flange thereabout integral therewith. The body is formed to provide the front side thereof as a flat, planar face and having a multiplicity of apertures therethrough from the front face to and opening through the rear side of the body. Sound wave dampening tubes are molded integrally with the body projecting rearwardly from the rear side thereof. Each of the dampening tubes has a passage therethrough opening at the rear end thereof. Each of the dampening tubes is located on the rear side of the body in position with a body aperture opening into and forming the inlet to the passage of the dampening tube. The body has the rear side thereof formed with an annular recess therein about each of the dampening tubes providing a reduced thickness base portion of the body with which the tube is integrally joined.

U.S. Pat. No. 2,924,856 to Price discloses in combination with generally flat, high density, relatively rigid acoustical tile having parallel, equally spaced apart, rows of sound-receptive perforations whose transverse dimensions are in the magnitude of the thickness of the tile. An elongated tile-supporting member of sheet metal having at least three co-planar elongated parallel rib surface portions extending for its entire length and adapted for face-to-face operative supporting contact with the tile. The rib surface portions of the member are integral therewith and disposed intermediately of adjacent pairs of rib surface portion. At least two V-shaped troughs spaced apart the same distance as the rows of perforations of the tile are spaced apart, and intersected by elongated relatively narrow apertures of uniform width separated longitudinally by imperforate relatively short apical portions of the sheet metal. A plurality of screw type fasteners extends through certain of the tile perforations into respective apertures of the troughs and are lockingly retained by edge portions defining opposite sides of associated apertures, so that each trough is aligned with a row of tile perforations and is partially exposed through the perforations. The thus exposed pairs of inclined faces defining the troughs are wide enough to span or bridge entirely across the perforations and are inclined relative to the axes of the perforations at such an angle that very little or no light or sound which may enter the perforations tends to be reflected back through the perforations by the exposed inclined faces.

U.S. Pat. No. 3,058,551 to Martin discloses an outside-type building wall construction which is designed to provide an elongated integral sheet material weight-carrying stud member having a generally S-shaped cross-section. The wall may be expected to be exposed to strong outside forces, such as wind. The construction comprises, in combination: an elongated flexible resilient sheet material weight carrying stud member having a generally S-shaped cross-section in a plane perpendicular to its length and having outer and inner substantially parallel plane surface portions, an outer weatherproof wall plate of sheet material securely fastened to one of the outer parallel plane surfaces of the stud. The outer parallel portions of the stud are connected integrally to the intermediate portion by resilient curved portions and the transition between the parallel and curved portions are gradual and without sharp turns. Resilient action is permitted in a plane perpendicular to the stud length and between the outer parallel portions as when the structure is submitted to outside pressures.

U.S. Pat. No. 3,136,397 to Eckel discloses an assembly with two angular adjoining walls and a ceiling. The assembly comprises a plurality of panels with a first of the panels extending along the ceiling from the first wall. A second of the panels extends along the first wall below the ceiling panel. A Z-shaped retainer embodying one angular portion is attached to the first wall. Another angular portion extends laterally away from the wall indirectly below the first ceiling panel and above the second panel. And a third angular portion extends downwardly away from the ceiling panel. The ceiling first panel rests on the other angular portion of the retainer.

U.S. Pat. No. 3,324,615 to Zinn discloses an acoustical wall partition for use between the floor and ceiling of a building, an upright channel interposed between the floor and ceiling. The channel includes a pair of spaced side flanges; opposed elongated floor and ceiling tracks upon, extending along, and respectively secured to the floor and ceiling. Each track includes a pair of upright spaced plates; a series of longitudinally spaced resilient wallboard supporting and backing tabs struck out from the flanges. Each tab includes a first plate joined to and extending at an acute angle from a flange, and terminating in a yieldable second plate extending from the first plate at an obtuse angle diverging from the flange and secured in face to face contact with a wallboard. The channel is interposed between the tracks with the respective top and bottom edges of its side flanges bearing against and retained between pairs of the track plates. The upright parallel spaced wallboards upon opposite sides of the channel bear against and are secured to the tabs.

U.S. Pat. No. 3,611,653 to Zinn discloses a sound attenuation wall partition adapted for use between a building floor and ceiling. The invention comprises opposed floor and ceiling channels secured respectively to and along the floor and ceiling. A series of upright longitudinally spaced studs of channel form are interposed between and projected into the channels. Each stud includes a transverse web terminating in a plane flange on one side and a panel stop flange on its other side having formed and projecting therefrom a series of longitudinally spaced coplanar yieldable tabs. The tabs are spaced outwardly of and parallel to the stop flange. The studs are arranged so that the plane flanges and stop flanges of adjacent studs are alternately arranged in substantial alignment, with the plane flanges of each stud bearing against and secured respectively to the side of the adjacent floor and ceiling channel. The corresponding stop flange is spaced from the side of the adjacent floor and ceiling channel. The studs are thus laterally staggered with respect to the floor and ceiling channels. Upright spaced opposed wall boards are interposed between the floor and ceiling channels and at their top and bottom edges secured to the opposite sides of the channels. Each wall board spans three adjacent studs. Fastening means interconnects the upright outer edges of each wall board with the plane flanges of the outer studs, and with the central portion of each wallboard throughout its height yieldingly bearing against the respective tabs on the intermediate stud stop flange. The opposing wallboards are longitudinally staggered whereby the outer upright edges of one wallboard span three adjacent studs which include two of the opposite wallboard supporting studs. The edge of a wallboard on one side of the channel is in registry with the channel portion of the wallboard on the opposite side of the channels.

U.S. Pat. No. 3,841,047 to Zinn discloses novel studs for use in wall constructions, characterized by their having two sides or flanges of different resiliency when formed and mounted. They may be of different resiliency when initially formed; or they may be of similar resiliency when initially formed, but become of different resiliency when mounted.

U.S. Pat. No. 3,949,827 to Witherspoon discloses an acoustical panel assembly having improved structural, decorative and acoustical properties. The panel assembly includes a perimeter frame. A thin septum member is supported in the center of the frame. A fibrous glass layer is positioned adjacent each side of the septum member. A molded, semi-rigid, fibrous glass diffuser member is positioned adjacent each of the fibrous glass layers. The assembly includes means for joining adjacent panel assemblies and, in one embodiment, an outer decorative fabric layer is positioned adjacent each of the outer surfaces of the diffuser members.

U.S. Pat. No. 3,950,912 to Lundberg et al. discloses a sound attenuating wall comprising a skeleton frame, surface layers secured thereto, skeleton frame members, and an insulation provided between the skeleton frame members and the surface layers, respectively. The skeleton frame members are formed by two elements which in point of strength act separately of each other and are interconnected by portions of material which are weak or slender in the direction of the plane of the wall. The insulation disposed in the wall fills out only part of the space therein.

U.S. Pat. No. 3,967,693 to Okawa discloses a means and method for diminishing energy of sound. A corrugated cover having holes therethrough is mounted on a wall by ribs and an edge plate. The wall and edge plate together with the ribs and corrugated cover form a plurality of chambers, each cooperating with a plurality of the holes for diminishing the energy of impinging sound waves.

U.S. Pat. No. 4,113,053 to Matsumoto et al. discloses a sound absorbing body which can effectively be utilized as an exterior sound absorbing wall or an interior wall of a house. The sound absorbing body comprises a number of sound absorbing cavities inclined at an angle alpha which is smaller than 80 degrees with respect to a transverse horizontal sectional plane of the body. The sound absorbing cavities are opened at the sound incident surface.

U.S. Pat. No. 4,160,491 to Matsumoto et al. discloses a perlite sound absorbing plate and a sound insulating wall constructed by arranging a number of the plates side by side and by assembling together into one integral body. The plate is composed of a mixture including 1,000 cc by bulk volume of formed perlite particles each having a diameter of 0.1 to 7.0 mm, 100 to 140 g of cement, liquid rubber latex containing 5 to 20 g of solid ingredients and a suitable amount of water and produced by press molding with a compression ratio of 1.10 to 1.30. The wall is constructed by assembling a number of the plates each provided with a side groove with the aid of supporting columns and reinforcing plates, each having a ridge adapted to be engaged with the side groove of the plate.

U.S. Pat. No. 4,207,964 to Taguchi discloses a sound absorbing and diffusing unit for assembling an acoustic screen which can be placed or hung in front of a wall inside an acoustic room for improving a sound-effect therein. These units are detachably joined together with each other so that they may be easily separated and assembled again to form an acoustic screen having another shape or construction to adjust or modulate a sound-effect. A sound absorbing porous panel having a desired picture or pattern can be easily hung against a wall. The decorative panel can be reversely hung on the wall to provide another interior ornamentation. Accordingly, an acoustically correct room and a desired ornamentation on a wall inside the acoustic room can be easily obtained and changed without providing a rigid reverberating surface of the room.

U.S. Pat. No. 4,248,325 to Georgopoulos discloses an improved sound absorptive tackable space dividing wall panel or similar article in which a wire mesh screen is disposed within the sound absorptive material a distance from the tackable surface less than the length of the tack pin, thereby providing additional support for the tackable load without appreciably reducing the sound absorptive characteristics of the panel.

U.S. Pat. No. 4,306,631 to Reusser discloses a noise barrier or other type wall or building assembly including a plurality of spans each extending between spaced apart posts and having top and bottom girts affixed to the posts and in turn supporting a plurality or series of vertically disposed panels. Unique mating interlock elements integrally formed along both lateral edges of the wall or building exterior panels allow the sequential interconnection of all panels in a series by means of a rotating displacement of the individual panels to yield multilateral interlocking of the panels. The panel faces are configured to provide shadow texture, while masking of the posts and top girt in a free-standing type wall is obtained by a split cover assembly and split cap trim, respectively.

U.S. Pat. No. 4,402,384 to Smith et al. discloses a sound barrier system particularly suited for out-of-doors, ground-mounted installations, such as for a highway noise barrier, comprising a vertical wall composed of successive individual wall sections arranged with immediately adjacent wall sections disposed at an intersecting angle to each other. Immediately adjacent wall sections are rigidly joined together in abutment along a common vertical joint. An earth anchor is anchored into the ground at each vertical joint. Each joint is secured to the corresponding earth anchor so that downwardly directed hold-down forces are applied by the earth anchors to the wall at the bottom portions of the joints.

U.S. Pat. No. 4,605,090 to Melfi discloses a post and panel type noise barrier fence formed of a plurality of concrete vertical posts or columns which have grooves to hold flat concrete panels between successive ones of the columns. The panels can have a stepped lower edge to accommodate elevational changes in the terrain. Also, certain of the columns have oppositely disposed recesses angled from each other so as to accommodate directional changes at the columns in the direction of the barrier fence.

U.S. Pat. No. 4,607,466 to Allred discloses an acoustic panel having a porous layer and a generally rigid layer affixed to each other. The generally rigid layer includes at least one passageway opening on one side of the rigid layer and extending through the rigid layer to the porous layer. The porous layer is a fibrous material. The rigid layer is a concrete-type material, such as vermiculite-cement plaster. This acoustic panel further comprises a generally rigid planar surface positioned adjacent to the porous layer. This generally rigid planar surface can comprise an insulating layer affixed to the other side of the porous layer and a structural layer fastened to the insulating layer. The insulating layer is a polyurethane foam board. The structural layer is a particle board.

U.S. Pat. No. 4,805,734 to Mast discloses an acoustic wall for streets and parks and for garden-like designs consisting of several substantially U-shaped frame members arranged at a distance from one another, which frame members are connected among one another and have mats applied on their front and side surfaces. In order to substantially reduce the manufacture on location, the duration of setting up and the greening time on location, the acoustic wall consists of individual elements of which each has several U-shaped frame members which are secured at the ends of their long legs on a base. The base forms a rigid frame with fastening means for the lifting and transporting of the acoustic wall. One or several narrow-mesh mats are secured on the base, which mats prevent a falling out of material filled into the acoustic wall during transport.

U.S. Pat. No. 4,834,213 to Yamamoto et al. discloses a noise silencer for highways adapted to be stuffed in a joint gap formed in a highway. It has a rectangular casing and padding enclosed in the casing. The casing is provided with a vent hole adapted to be closed by a plug. Before mounting the noise silencer, air is firstly sucked out from the silencer through the vent hole to flatten the padding and the vent hole is plugged. After the silencer has been mounted, the vent hole is open to inflate the padding so that the silencer will be pressed against the opposite walls of the joint gap.

U.S. Pat. No. 5,217,771 to Schmanski et al. discloses a device for preventing the transmission of sound. The device is fabricated of polymer composition and comprises a hollow core member formed of fiber-reinforced thermosetting resin, and at least outer member formed of unreinforced thermoplastic resin which is friction fit to the core member. The core member and outer members are preferably formed by pultrusion and extrusion, respectively. Adjacently disposed devices are connected together to form a fence-like barrier through which few or no sound waves are allowed to pass. This system is advantageously used to prevent sound waves emanating from a large transportation structure such as a highway, railroad track, or airport.

U.S. Pat. No. 5,272,284 to Schmanski discloses a sound wall for placement along a roadside for reducing the transmission of sound from a traffic area wherein the sound wall comprises a plurality of stiff, resilient containment members respectfully configured with the channel configuration and having an enclosed channel volume and continuous open side. Each channel volume is filled with a composite composition of rubber chips and binder compressed within the channel and substantially filling the channel volume. These containment members are stacked in nesting relationship to form a wall structure, with the open side being oriented toward the traffic area.

U.S. Pat. No. 5,787,651 to Horn et al. discloses a sound deadening wall assembly comprising a first wall panel attached to a first stud member, a second wall panel situated parallel to the first wall panel and attached to a second stud member, wherein the stud members abut each other with a resilient attachment material therebetween to secure the first and second stud members to each other. The stud members are of C-shape cross-section with the open end of the C-shape facing in opposite directions and a butting each other to crate an overall S-shape when the stud members are joined together. Separable end and top members are also disclosed.

U.S. Pat. No. 6,266,936 B1 to Gelin discloses a sound attenuating wall or ceiling assembly including: a plurality of wall or ceiling boards; a series of parallel spaced apart, elongated framing members; and a series of elongated sound attenuating members extending along the length of the framing members, secured to the framing members and securing the boards to the framing members. Each of the sound attenuating members has a resilient cantilevered portion to which the boards are secured. The cantilevered portion of each sound attenuating member extends from the framing member to which the sound attenuating member is secured both outward away from the framing member and toward an adjacent framing member whereby the boards are resiliently secured to the framing members and spaced outwardly from the framing members to attenuate sound.

U.S. Pat. RE 28,976 to Zinn discloses a method for providing, arranging, and mounting a line or series of studs, between parallel fixed structures of building so that each stud when as formed and mounted has a more resilient flange and a less resilient flange and so that the more resilient flanges of any two adjacent studs face in opposite directions; equally the less resilient flanges of two adjacent studs also face in opposite directions. The method further includes the step of providing, arranging and mounting wall panels in staggered, alternated relation on the studs with the edges of two adjacent panels being secured to the less resilient flange of the same stud, and the center of each panel is adjacent the more resilient flange of a stud between the first named pair of studs. The studs may have less resilient and more resilient flanges as originally formed, and/or only one flange may be anchored to the channels to make that flange less resilient than the unanchored flange. In the mounting of the panels, the center of each panel has a bearing at a more resilient flange.

U.S. Pat. RE 29,412 to Zinn discloses novel studs for use in wall constructions, characterized by—two sides or flanges of different resiliency when formed and mounted. They may be of different resiliency when initially formed; or they may be of similar resiliency when initially formed, but become of different resiliency when mounted.

Therefore, it is an object of the present invention to provide a sound transmission reducing system for reducing the transmission of acoustical energy through a wall between adjacent volumes.

Another object of the present invention is to provide a sound transmission reducing system incorporating a novel supporting beam with reduced transmission of acoustic energy therethrough.

Another object of the present invention is to provide a sound transmission reducing system incorporating a novel supporting beam having a pocket for mounting an acoustical panel.

Another object of the present invention is to provide a sound transmission reducing system incorporating a novel bracket with reduced transmission of acoustic energy therethrough.

Another object of the present invention is to provide a sound transmission reducing system incorporating plural supporting beams for mounting sides of an acoustical panel.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved system for reducing the transmission of acoustical energy between a first and second wall surface of a wall. The system comprises a first and a second beam for supporting a sound panel. Each of the first and second beams comprises a first and a second flange interconnected by an inner connector. Each of the first and second beams has a fold defined in the inner connector for reducing the transmission of acoustical energy between the first and second flange. The fold cooperates with one of the flanges for defining a pocket for receiving an edge of a sound panel. The first and second flange support the first and second wall surface of the wall.

In a more specific embodiment of the invention, the system comprises a first and a second beam for supporting side portions of the first and second wall surfaces of the wall. A lower and an upper bracket supports a lower and an upper portions of the first and second wall surfaces of the wall. Each of the first and second beams have a fold for reducing the transmission of acoustical energy between the first and second wall surfaces of the wall. Each of the first and second brackets have a plurality of voids for reducing the transmission of acoustical energy between the first and second wall surfaces of the wall.

In one embodiment of the invention, the system includes a beam for reducing the transmission of acoustical energy between a first and second wall surface of a wall. The beam comprises a first and a second flange for supporting the first and second wall surface of the wall. An inner connector has a first and a second end secured to the first and second flange, respectively. A fold is defined in the inner connector for reducing the transmission of acoustical energy between the first and second flange. The fold cooperates with the inner connector for defining a pocket for mounting a sound panel.

In another embodiment of the invention, the system includes a bracket for reducing the transmission of acoustical energy between a first and second wall surface of a wall and a mounting surface. The bracket comprises a first and a second flange for supporting the first and second wall surface of the wall. An inner connector has a first and a second end secured to the first and second flange, respectively. A mounting comprises a bore located in the inner connector for mounting the bracket. A plurality of voids are defined in the inner connector for reducing the transmission of acoustical energy between the first and second flange and the mounting.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

DETAILED DISCUSSION

Figure 1:
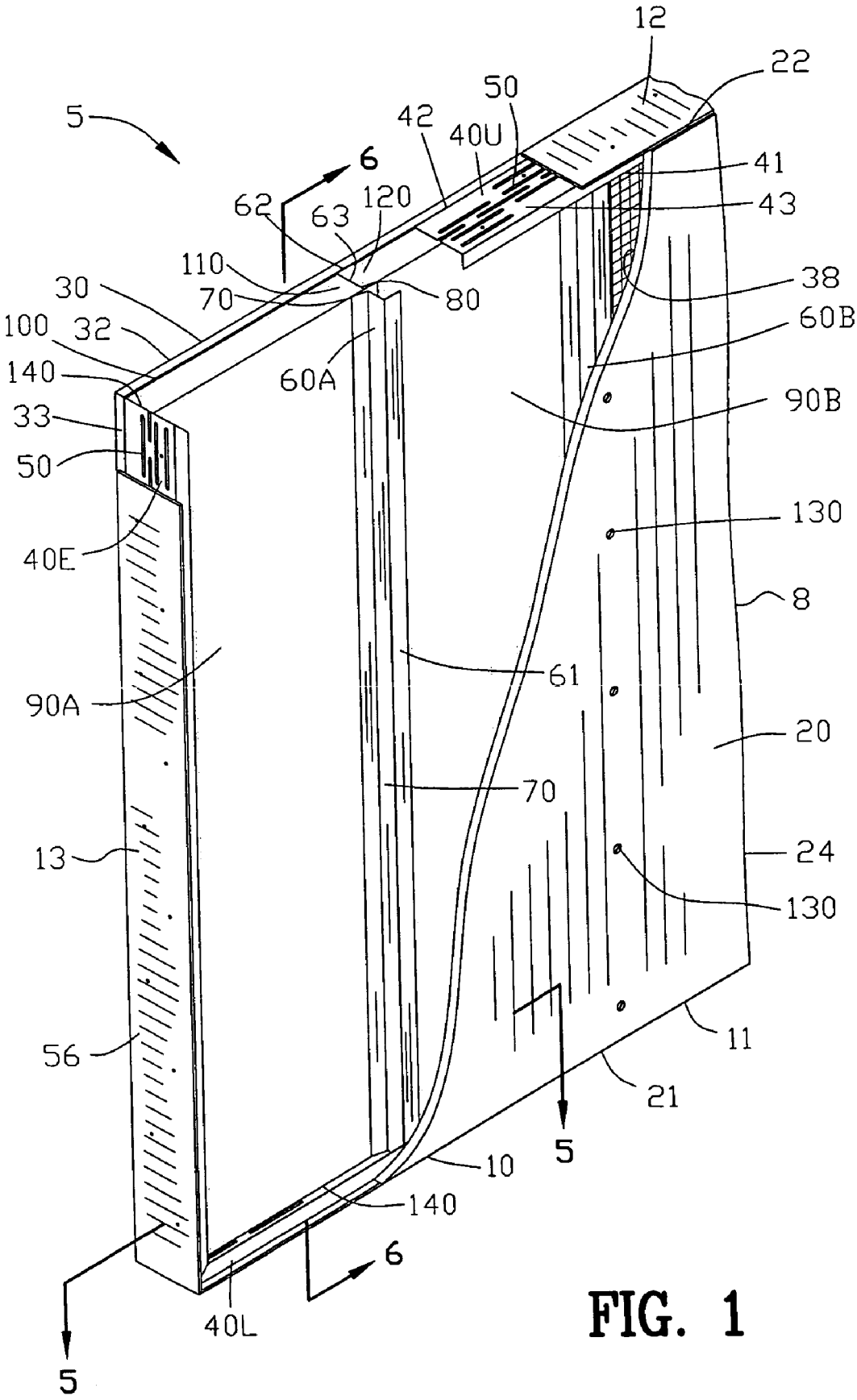
FIG. 1 is an isometric view of the improved sound reducing system of the present invention.
Figure 2:
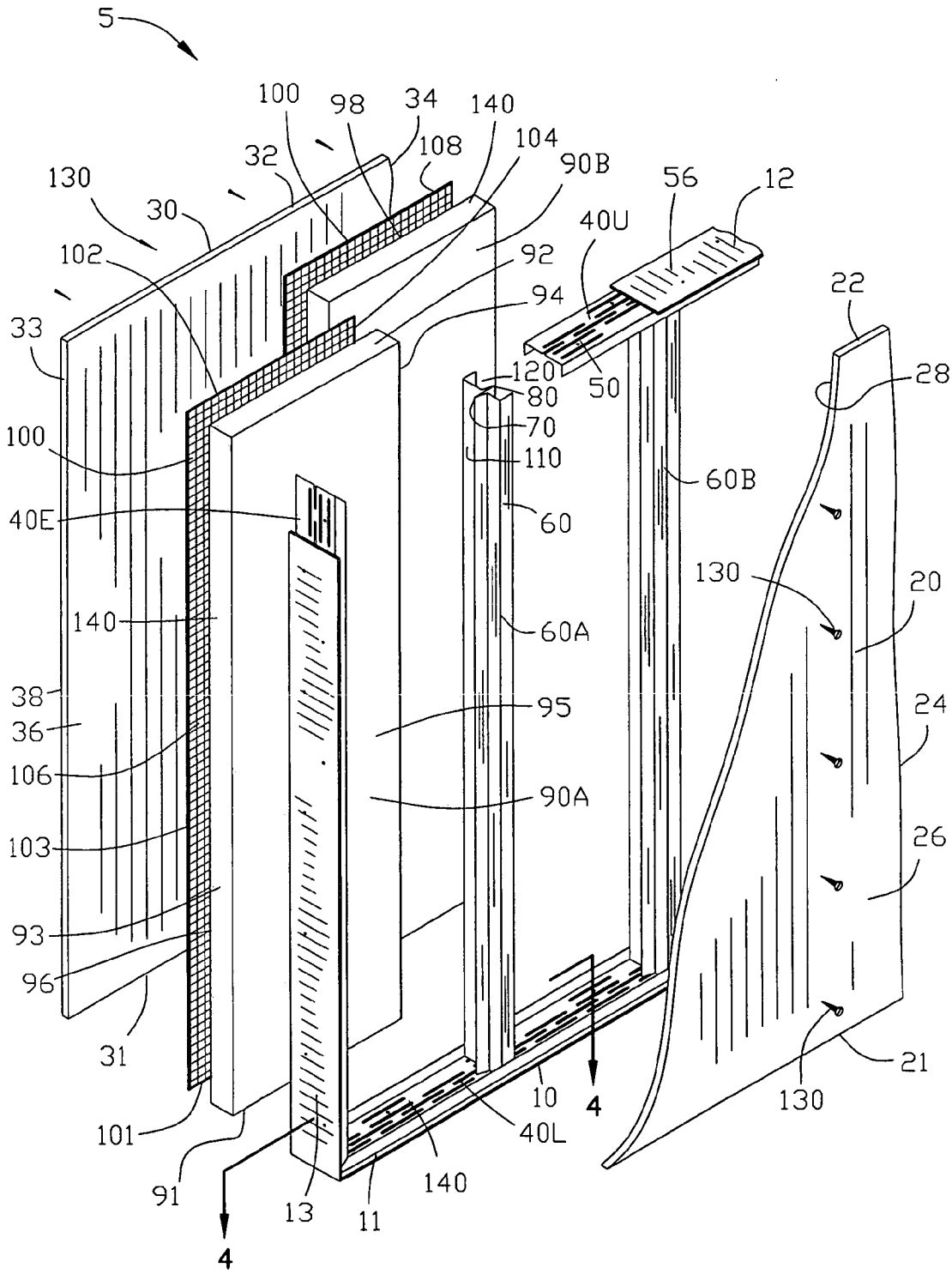
FIG. 2 is an exploded view of FIG. 1.

FIGS. 1 and 2 illustrates a system 5 for reducing the transmission of acoustical energy through a wall 8 secured to a support 10. The support 10 comprises a lower support surface 11 and an upper support surface 12 a side support surface 13. The lower and upper support surfaces 11 and 12 may be representative of a floor and a ceiling of a building structure. The side support surface 13 may be representative of an internal and/or an external wall of the building structure. It should be understood that an additional side support surface is required to acoustically isolate the opposed sides of the wall 8.

The wall 8 includes a first and a second wall surface 20 and 30. The first wall surface 20 defines a lower edge 21, and upper edge 22 and side edges 23 and 24. The first wall surface 20 further defines a first side surface 26 and a second side surface 28. In a similar fashion, the second wall surface 30 defines a lower edge 31, and upper edge 32 and side edges 33 and 34. The second wall surface 30 further defines a first side surface 36 and a second side surface 38.

A bracket 40 shown as a lower bracket 40L, an upper bracket 40U and an end bracket 40E. Each of the brackets 40L, 40U and 40E is substantially identical to one another. Each of the brackets 40 comprises a longitudinally extending bracket 40. The bracket 40 has a first and a second flange 41 and 42 interconnected by an inner connector 43. As will be described in greater detail hereinafter, a mounting 50 secures the inner connector 43 of the brackets 40L, 40U and 40E to the lower support surface 11, the upper support surface 12 and the side support surface 13. The first and second flanges 41 and 42 of the brackets 40L, 40U and 40E support the first and second wall surfaces 20 and 30 of the wall 8.

The system 5 comprises a longitudinally extending beam 60 shown as a plurality of beams 60A and 60B for supporting the first and the second wall surfaces 20 and 30. Each of the plurality of beams 60A and 60B is substantially identical to one another. Each of the beams 60 comprises a first and a second flange 61 and 62 interconnected by an inner connector 63. As will be described in greater detail hereinafter, the first and second flanges 61 and 62 of the plurality of beams 60A and 60B support the first and second wall surfaces 20 and 30 of the wall 8.

The beams 60 have an inner fold 70 and an outer fold 80. The inner and outer folds 70 and 80 are unitary with the inner connector 63. The plurality of beams 60A and 60B support a sound panel 90 shown as a plurality of sound panels 90A and 90B. As will be described in greater detail hereinafter, the plurality of sound panels 90A and 90B are retained by the inner and outer folds 70 and 80 of the beams 60. The first fold member 70 forms a first converging pocket 110 whereas the second fold member 80 forms a second converging pocket 120.

Each of the plurality of sound panels 90A and 90B is substantially identical to one another. Each of the sound panel 90 defines a lower edge 91, and upper edge 92 and side edges 93 and 94. The sound panel 90 further defines a first side surface 95 and a second side surface 96. The sound panel 90 may comprise a sound absorbing member 90 formed from a multiplicity of fibers 97 defining a multiplicity of pores 98 between adjacent fibers 97. The multiplicity of fibers 97 enables the sound and/or noise to enter through the multiplicity of pores 98 and to be dispersed by the multiplicity of fibers 97 within the sound absorbing member 90. In one example of the invention, the sound absorbing member 90 is formed from one to two inch thick fiber glass fiber board having a density of 6 pounds per square foot.

In this example, the sound panel 90 includes an auxiliary sound panel 100 secured to the sound panel 90. The auxiliary sound panel 100 defines a lower edge 101, and upper edge 102 and side edges 103 and 104. The auxiliary sound panel 100 further defines a first surface 106 and a second side surface 108.

The auxiliary sound panel 100 may comprise a sheet of non-porous mineral filled vinyl polymeric material having a thickness of approximately one-eighth of an inch and having a weight equal to or greater than one pound per square foot. Preferably, the auxiliary sound panel 100 is a loaded mass vinyl having a sound transmission coefficient greater than 25. A suitable material is sold under the Registered Trademark Acoustiblok by Acoustiblok, Inc. of Tampa, Fla. (www.acoustiblok.com).

In this example, the first side surface 106 of the auxiliary sound panel 100 is affixed to the second side surface 96 of the sound panel 90. Preferably, the first side surface 106 of the auxiliary sound panel 100 is affixed to the second side surface 96 of the sound panel 90 by a suitable adhesive.

Figure 3:
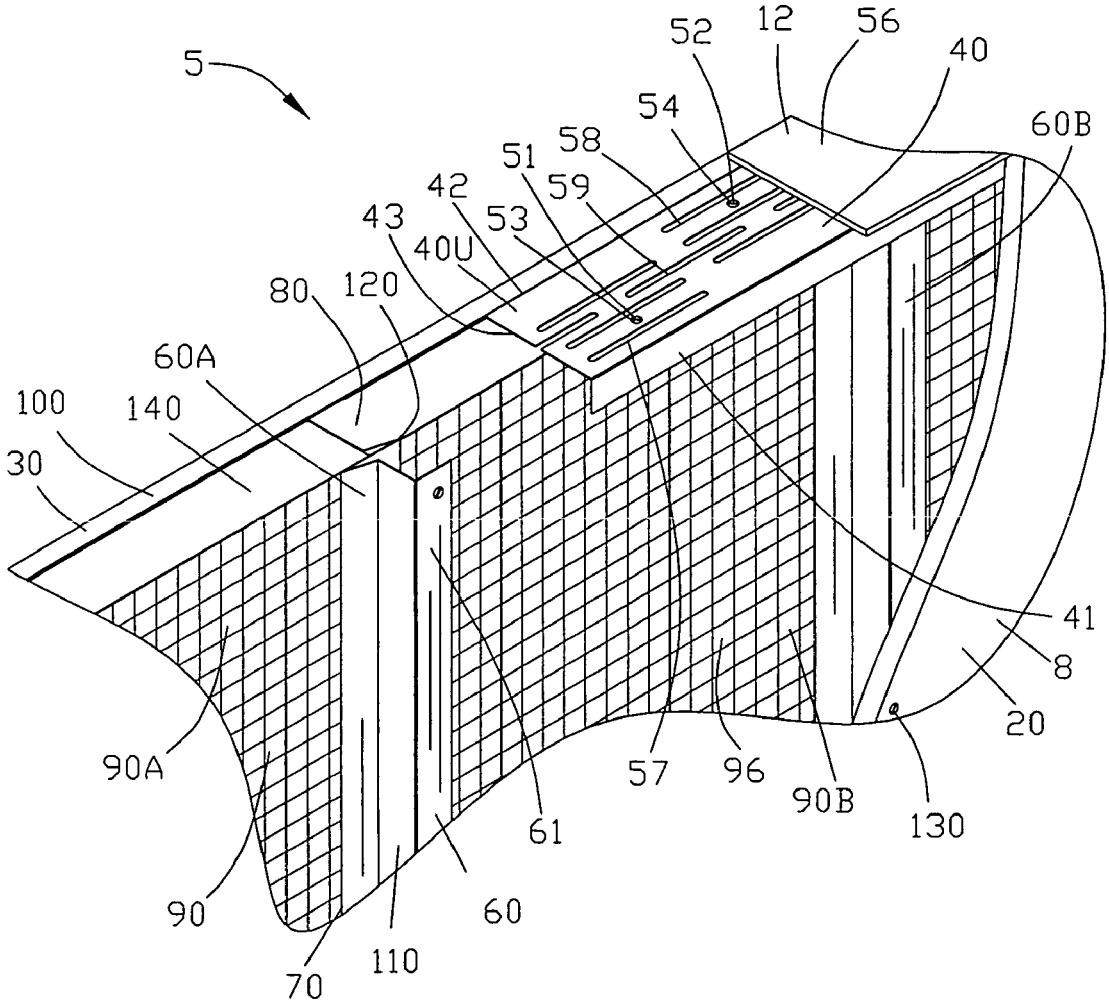
FIG. 3 is an enlarged view of a portion of FIG. 1.
Figure 4:
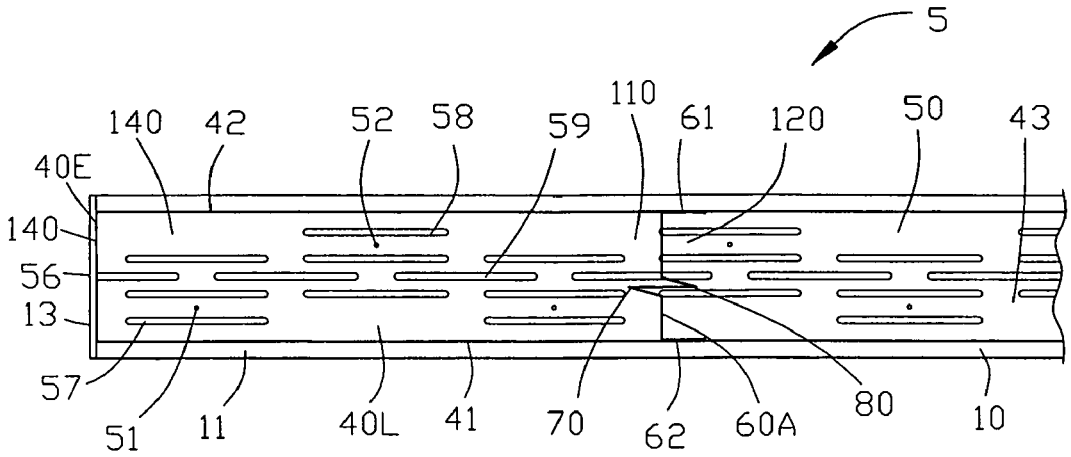
FIG. 4 is a view a long line 4-4 in FIG. 2.
Figure 5:
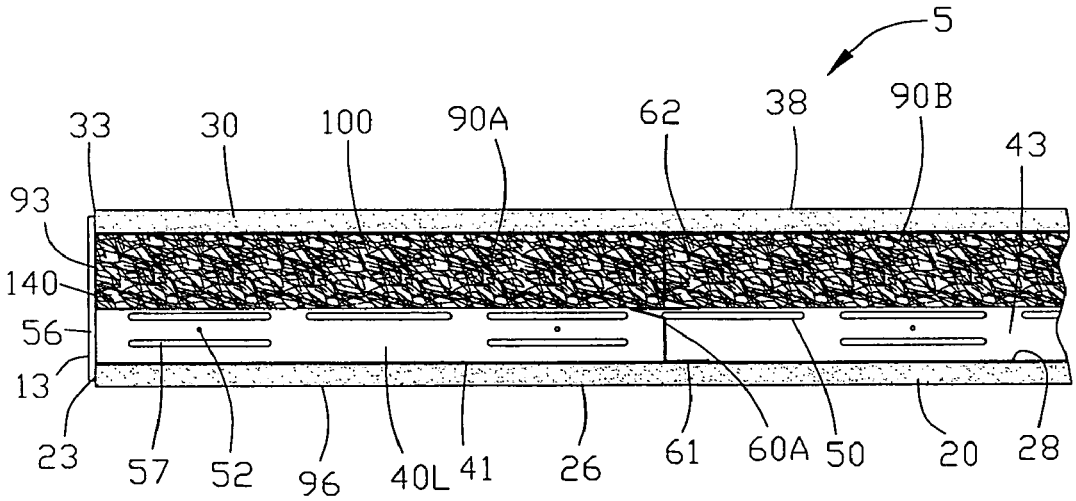
FIG. 5 is an enlarged view a long line 5-5 in FIG. 1.
Figure 6:
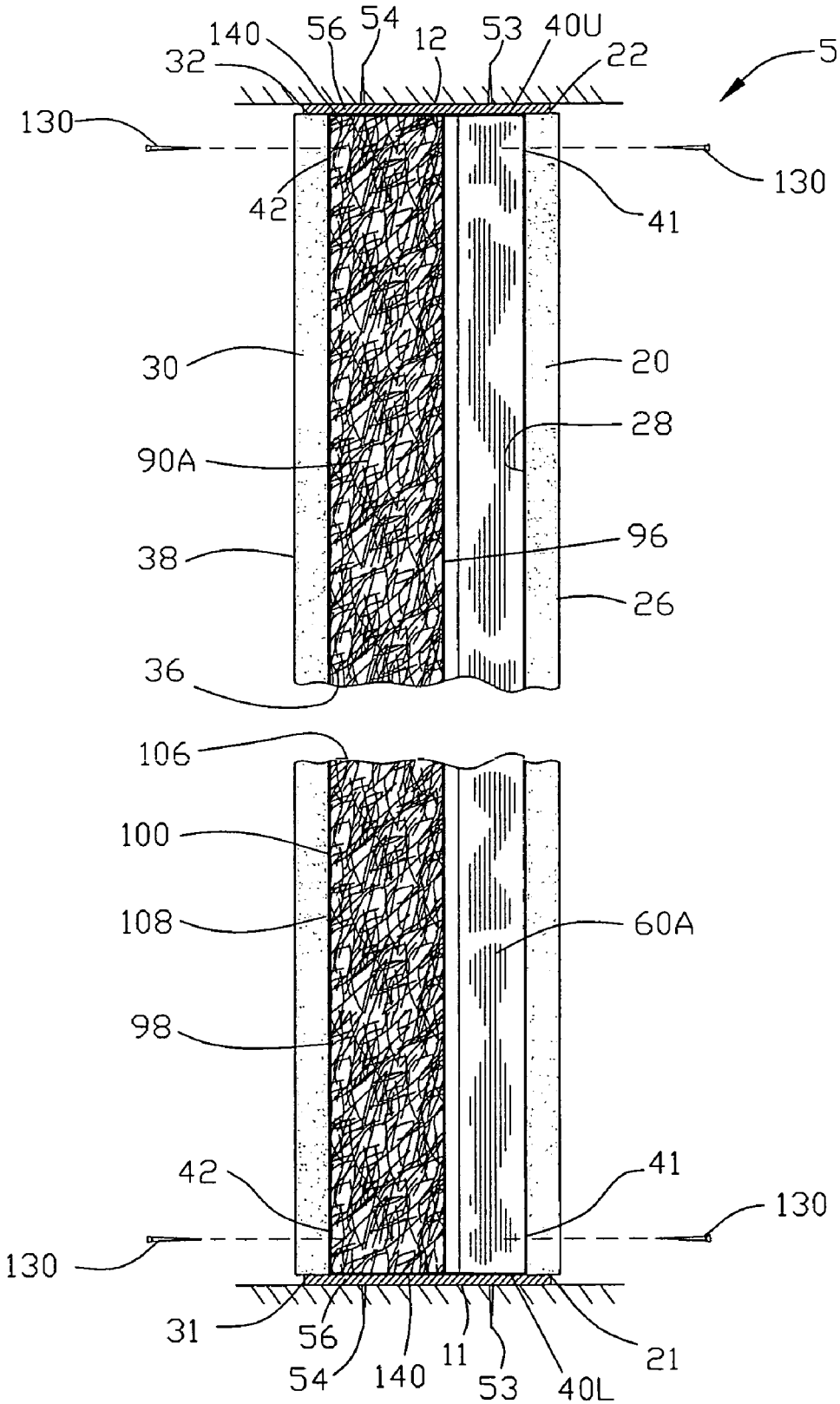
FIG. 6 is a sectional view along lines 6-6 in FIG. 1.
Figure 7:
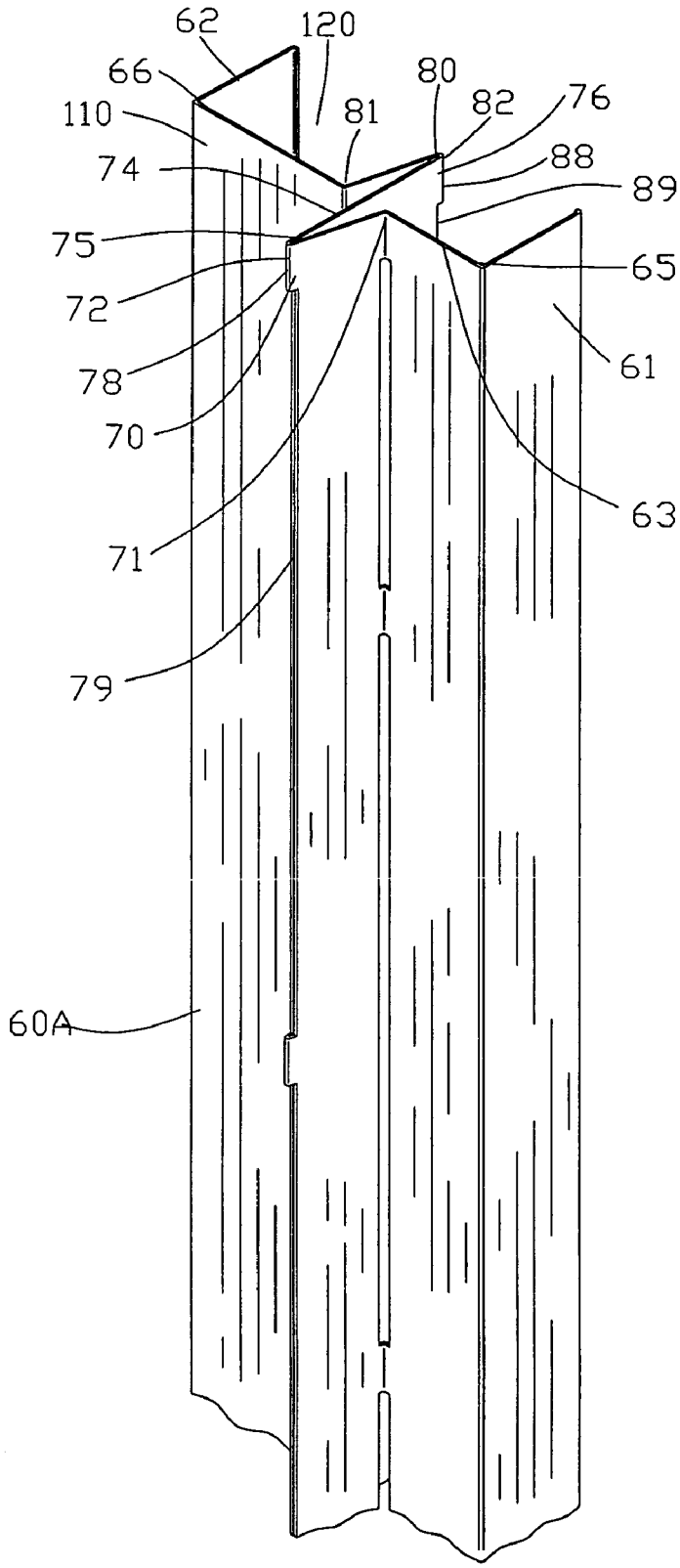
FIG. 7 is an enlarged view of a portion of the improved supporting beam shown in FIGS. 1-3.

FIG. 3 is an enlarged view of the upper portion of FIG. 1 illustrating the upper bracket 40U. The brackets 40U comprises the first and the second flange 41 and 42 interconnected by the inner connector 43. Preferably, the brackets 40U is formed from a single piece metallic member with the first and second flanges 41 and 42 being unitary with the inner connector 43.

The first and second flanges 41 and 42 of the brackets 40U support the first and second wall surfaces 20 and 30 of the wall 8. The first and second wall surfaces 20 and 30 are secured to the first and second flanges 41 and 42 by conventional fasteners 130. The conventional fasteners 130 extend through the first and second wall surfaces 20 and 30 to engage with the first and second flanges 41 and 42. The conventional fasteners 130 maybe conventional screws fasteners or any other suitable fastener.

The brackets 40U includes the mounting 50 comprising a plurality of bores 51 and 52 located intermittently along the inner connector 43 for mounting the bracket 40. A plurality of fasteners 53 and 54 extend through the plurality of bores 51 and 52 to affix the brackets 40U to the upper support surface 12.

The mounting 50 may include an optional resilient material 56 located between the inner connector 43 and the upper support surface 12. The optional resilient material 56 may be secured to the inner connector 43 by a suitable adhesive. In the alternative the optional resilient material 56 may be located between the inner connector 43 and the upper support surface 12 when the bracket 40U is affixed to the upper support surface 12 by the plurality of fasteners 53 and 54. The optional resilient material 56 reduce the transmission of acoustical energy between the inner connector 43 and the upper support surface 12.

A plurality of voids 57-59 are defined in the inner connector 43 for reducing the transmission of acoustical energy between the first and second flange 41 and 42 and the mounting 50. Each of the plurality of voids 57-59 comprises a longitudinally extending groove disposed generally parallel to the first and second flange 41 and 42. At least one of the grooves 57 is located between each of the bores 51 and the first flange 41. At least one of the grooves 59 is located between each of the bores 52 and the second flange 42. At least one of the grooves 58 is located between each of the bores 51 and 52.

The plurality of voids 57-59 reduce the transmission of acoustical energy between the first and second flanges 41 and 42 and the mounting 50. The plurality of voids 57-59 eliminate a direct path for acoustical energy applied to the first and second flanges 41 and 42 by the first and second wall surface 20 and 30 to the plurality of fasteners 53 and 54. The plurality of voids 57 eliminate a direct path for acoustical energy through the inner connector 43 from the first flange 41 to the plurality of fasteners 53. Similarly, the plurality of voids 59 eliminate a direct path for acoustical energy through inner connector 43 from the second flange 42 to the plurality of fasteners 54. The plurality of voids 58 eliminate a direct path for acoustical energy through inner connector 43 between the first and second flanges 41 and 42 to the plurality of fasteners 53 and 54.

FIGS. 4-7 illustrate the beam 60A with the first and a second flange 61 and 62 interconnected by the inner connector 63. The inner connector 63 extends between a first and a second end 65 and 66 adjacent to the first and second flange 61 and 62, respectively. Preferably, the beam 60A is formed from a single piece metallic member with the first and second flanges 61 and 62 being unitary with the inner connector 63.

The first and second flanges 61 and 62 of the beam 60A support the first and second wall surfaces 20 and 30 of the wall 8. The first and second wall surfaces 20 and 30 are secured to the first and second flanges 61 and 62 by the conventional fasteners 130. The conventional fasteners 130 extend through the first and second wall surfaces 20 and 30 to engage with the first and second flanges 61 and 62.

The beam 60A having an inner first fold 70 and an outer second fold 80 defined in the inner connector 63 for reducing the transmission of acoustical energy between the first and second flange 61 and 62. The first fold 70 and the second fold 80 are unitary with the inner connector 63. The first fold member 70 extends from a first fold base 71 at the inner connector 63 to a first fold distal end 72. The first fold member 70 extends from the inner connector 63 in an opposite direction to the first and second flanges 61 and 62 extending from the inner connector 63. The second fold member 80 extends from a second fold base 81 at the inner connector 63 to a second fold distal end 82. The second fold member 80 extends from the inner connector 63 in the same direction as the first and second flanges 61 and 62 extending from the inner connector 63.

An intermediate fold member 74 extending between a first and a second end 75 and 76. The first end 75 of the intermediate fold member 74 is integral with the first fold distal end 72 to form a first fold apex 78 forming an acute angle. The second end 76 of the intermediate fold member 74 is integral with the second fold distal end 82 to form a second fold apex 88 forming an acute angle.

The first fold apex 78 includes a plurality of voids 79 intermittently located along the first fold apex 78 for reducing the transmission of acoustical energy between the first and second flange 61 and 62. In a similar manner, the second fold apex 88 includes a plurality of voids 89 intermittently located a long the second fold apex 88 for reducing the transmission of acoustical energy between the first and second flange 61 and 62.

The first fold member 70 forms the first converging pocket 110 for receiving the edge 94 of the sound panel 90A. In a similar manner, the second fold member 80 forms the second converging pocket 120 for receiving the edge 93 of the sound panel 90B. The first and second converging pockets 110 and 120 resiliently engages the first and second side surfaces 95 and 96 of the sound panels 90A and 90B.

The first converging pocket 110 forms a tapered pocket between the intermediate fold member 74 and the first side surface 36 of the second wall surface 30. The intermediate fold member 74 extends at an angle relative to the second flange 62 for creating the converging first pocket 110 toward the inner connector 63. When the first side surface 96 of the sound panel 90A engages the intermediate fold member 74, the first side surface 35 of the second wall surface 30 resiliently engages the second side surface 96 of the sound panel 90A. The resilient engagement between the first converging pocket 110 and the sound panel 90A forms a seal between the non-porous auxiliary sound panel 100A and the beam 60A.

The second converging pocket 120 forms a tapered pocket between the second fold 80 and the second flange 62 of the beam 60A. The second fold 80 extends at an angle relative to the second flange 62 for creating the converging second pocket 120 toward the inner connector 63. When the first side surface 96 of the sound panel 90B engages the second fold 80, the second flange 62 of the beam 60A resiliently engages the second side surface 96 of the sound panel 90B. The resilient engagement between the second converging pocket 120 and the sound panel 90B forms a seal between the non-porous auxiliary sound panel 100B and the beam 60A.

FIGS. 8-12 illustrates the final assembly of the system 5 for reducing the transmission of acoustical energy between the first and second wall surface 20 and 30 of the wall 8. The bracket 40L is affixed to the lower support surface 11 with fasteners 130. Preferably, the optional resilient material 56 is interposed between the bracket 40L and the lower support surface 11. The bracket 40E is affixed to the side support surface 13 with fasteners 130. Preferably, the optional resilient material 56 is interposed between the bracket 40E and the side support surface 13. The bracket 40U is affixed to the upper support surface 12 with fasteners 130. Preferably, the optional resilient material 56 is interposed between the bracket 40U and the upper support surface 12. The fasteners 130 interconnect the intersections of the bracket 40L, the bracket 40E and the bracket 40U.

The beams 60A and 60B are affixed to the bracket 40L and 40U in a conventional spaced relationship in accordance with building code regulations. The fasteners 130 interconnect the longitudinal ends of the beams 60A and 60B to the bracket 40L and 40U. The first wall surface 20 is secured to the first flanges 41 of the bracket 40L, the bracket 40E and the bracket 40U by the fasteners 130. The first wall surface 20 is secured further to the first flanges 61 of the beams 60A and 60B.

Figure 8:
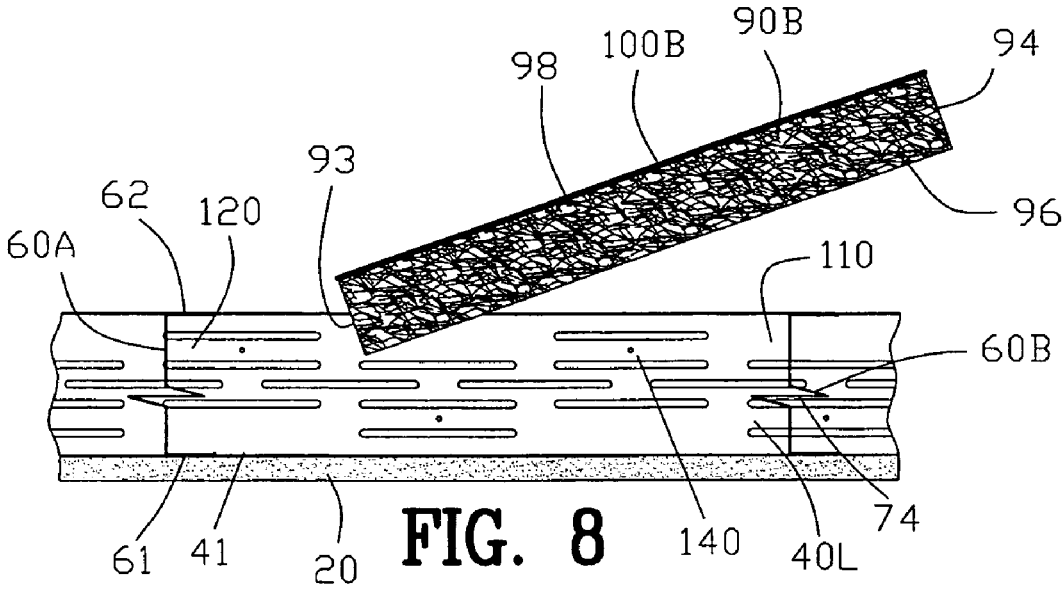
FIG. 8 is a top view illustrating a first step of inserting a sound panel into the sound reducing system of the present invention.

Preferably, an adhesive 140 is applied to the side edge 93 of the sound panel 90A and/or applied to the bracket 40E. The side edge 93 of the sound panel 90A is inserted to engage the bracket 40E. The adhesive 140 seals the side edge 93 of the sound panel 90A to the bracket 40E. The side edge 94 of the sound panel 90A is inserted within the first pocket 110 of the beams 60A. FIG. 8 illustrates the positioning of the side edge 93 of the sound panel 90B adjacent to the beam 60A. The sound panel 90B is positioned adjacent to the intermediate fold member 74 of the beams 60A and 60B whereas the auxiliary sound panel 100B is positioned adjacent to the second flanges 62 of the beams 60A and 60B.

Figure 9:
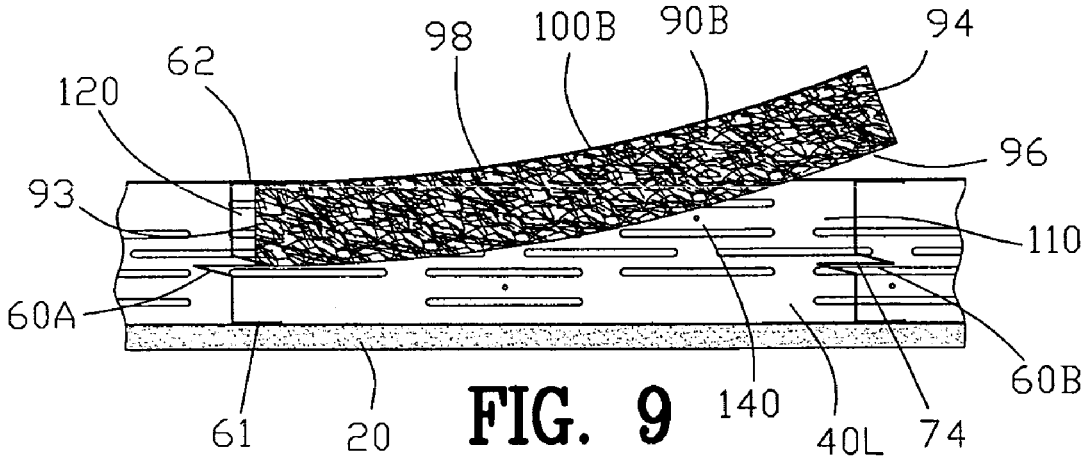
FIG. 9 is a top view similar to FIG. 8 illustrating a first edge of the sound panel being inserted into a pocket in the improved supporting beam.

FIG. 9 illustrates the insertion of the side edge 93 of the sound panel 90B into the second pocket 120 of the beams 60A. The first side surface 96 of the sound panel 90B resiliently engages the inner fold 70. The second side surface 108 of the non-porous auxiliary sound panel 100B resiliently engages the second flange 62 of the beam 60A. The resilient engagement between the second converging pocket 120 and the sound panel 90B forms a seal between the non-porous auxiliary sound panel 100B and the beam 60A.

Figure 10:
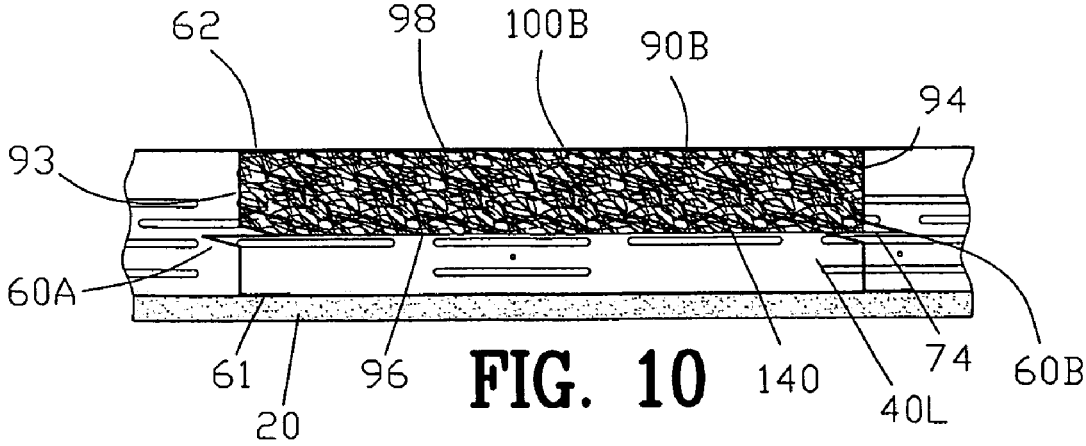
FIG. 10 is a top view similar to FIG. 9 illustrating a second edge of the sound panel being inserted adjacent to an adjacent improved supporting beam.

FIG. 10 illustrates the insertion of the side edge 94 of the sound panel 90B into the first pocket 110 of the beams 60B. The first side surface 96 of the sound panel 90B engages the intermediate fold member 74.

Figure 11:
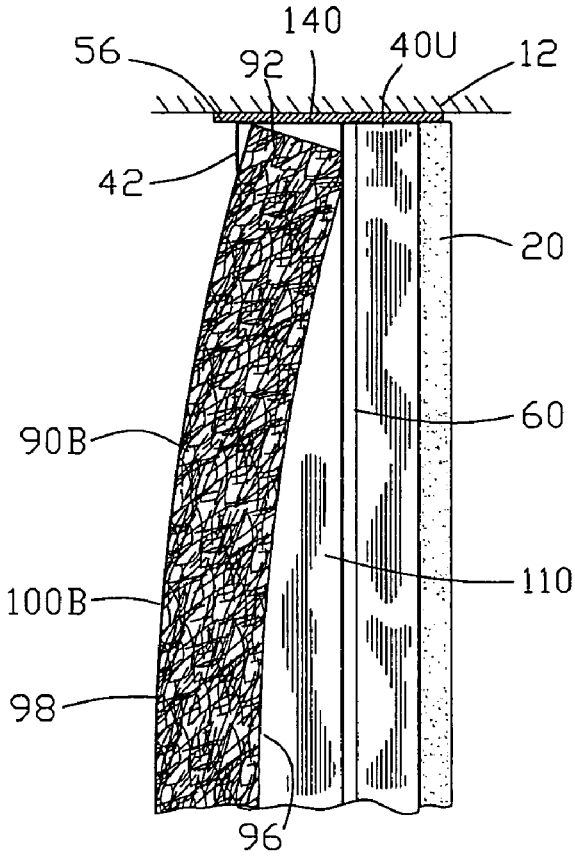
FIG. 11 is an enlarged view of an upper portion of FIG. 6 illustrating an upper edge of the sound panel being inserted within an upper bracket.

FIG. 11 illustrates the insertion of the upper edge 92 of the sound panel 90B within the second flange 42 of the bracket 40U. Preferably, the adhesive 140 is applied to the upper edge 92 of the sound panel 90B and/or the bracket 40U. The adhesive 140 seals the upper edge 92 of the sound panel 90B to the bracket 40E. The side edge 94 of the sound panel 90A is inserted within the first pocket 110 of the beams 60A.

The sound panel 90B is flexible enabling the sound panel 90B to be bent for insertion within the second flange 42 of the bracket 40U. The second side surface 108 of the non-porous auxiliary sound panel 100B engages the second flange 42 of the bracket 40U.

Figure 12:
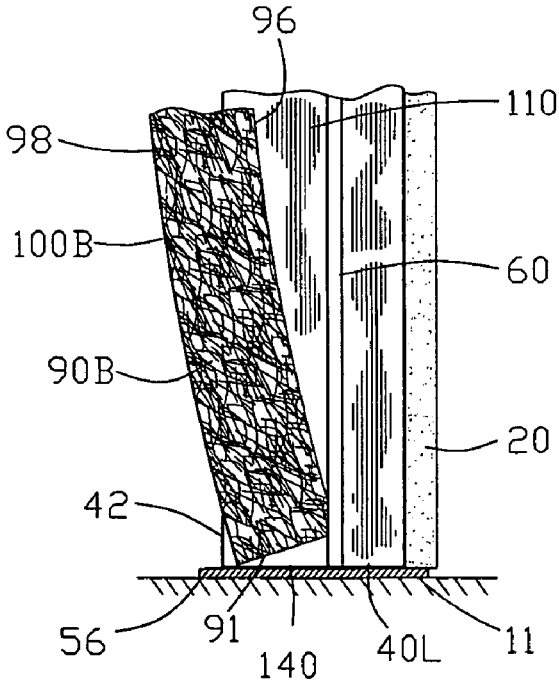
FIG. 12 is an enlarged view of a lower portion of FIG. 6 illustrating a lower edge of the sound panel being inserted within a lower bracket; and Similar reference characters refer to similar parts throughout the several Figures of the drawings.

FIG. 12 illustrates the insertion of the lower edge 91 of the sound panel 90B within the second flange 42 of the bracket 40L. The adhesive 140 is applied to the lower edge 91 of the sound panel 90B and/or the bracket 40L. The adhesive 140 seals the lower edge 91 of the sound panel 90B to the bracket 40L. The sound panel 90B is bent for insertion within the second flange 42 of the bracket 40L. The second side surface 108 of the non-porous auxiliary sound panel 100B engages the second flange 42 of the bracket 40L.

The second wall surface 30 is secured to the second flanges 42 of the bracket 40L, the bracket 40E and the bracket 40U by the fasteners 130. The second wall surface 30 is secured further to the second flanges 62 of the beams 60A and 60B. The second wall surface 30 cooperates with the intermediate fold member 74 to form the first converging pocket 110 of the beams 60A and 60B. The second wall surface 30 resiliently engages the second side surface 108 of the auxiliary sound panel 100A to form a seal with the beams 60A and 60B.

A sealant material (not shown) may be used to further reducing the transmission of acoustical energy through the components of the system 5. The sealant material (not shown) may be used to create air tight seals between all of the components of the system 5. The sealant material (not shown) may be used to create air tight seals between the components of the system 5 and the support 10.

The system 5 reduces the transmission of acoustical energy such as noise, music and the like through the wall 8. The bracket 40L, bracket 40U and bracket 40E are provided with a plurality of voids 57-59 defined in the inner connector 43 for reducing the transmission of acoustical energy between the first and second flange 41 and 42 and the mounting 50.

The system 5 comprises beams 60A and 60B having first and second folds 70 and 80 for reducing the transmission of acoustical energy between the first and second flanges 61 and 62. The beams 60A and 60B define a first and a second pocket 70 and 80 for mounting sound panels 90A and 90B.

The sound panels 90A and 90B are sound absorbing members for enabling sound and/or noise to enter the first side 96 of the sound panels 90A and 90B and to be dispersed by the multiplicity of fibers 97 within the sound panels 90A and 90B. The auxiliary sound panel 100 is secured to the second side 98 of the sound panels 90A and 90B. The auxiliary sound panel 100 blocks sound and/or noise from emanating second side 98 from the sound panels 90A and 90B.

The system 5 reduces the transmission of acoustical energy such as noise, music and the like through the wall 8 by the use of a combination of uniquely designed brackets 40, uniquely designed beams 60, uniquely designed sound panels 90 and uniquely designed auxiliary sound panel 100. It should be understood that each of the uniquely designed brackets 40, the uniquely designed beams 60, the uniquely designed sound panels 90 and the uniquely designed auxiliary sound panel 100 represent individual contributions to the acoustic art.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved wall system for reducing the transmission of acoustical energy therethrough, the wall system comprising:

a first beam and a second beam being identical to one another;

each of said first beam and said second beam having a first and a second flange interconnected by an inner connector;

said inner connector of each of said first beam and said second beam having an inner fold and an outer fold extending from said inner connector;

each of said first beam and said second beam including said first flange and said second flange and said inner connector including said inner fold and said outer fold being a unitary metallic member;

said first beam and said second beam being secured in a spaced apart generally parallel relationship for forming a wall support;

a first wall surface secured to said first flange of said first beam and said second beam;

a second wall surface secured to said second flange of said first beam and said second beam;

a sound reducing panel comprising a sound absorbing portion affixed to a sound blocking portion;

said sound absorbing portion comprising a porous member for dispersing acoustical energy for dispersing sound within said sound absorbing panel;

said sound blocking portion comprising a non-porous member for blocking the transmission of acoustical energy;

said sound reducing panel being retained in a first pocket and a second pocket;

said first pocket being defined between one of said inner fold and said outer fold and one of said first flange and said second flange; and said second pocket being defined between the other of said inner fold and said outer fold and one of said first wall surface and said second wall surface for reducing the transmission of acoustical energy between said first wall surface and said second wall surface.

2. An improved wall system for reducing the transmission of acoustical energy as set forth in claim 1, wherein said sound blocking portion of said sound reducing panel is affixed to said sound absorbing portion of said sound reducing panel by a suitable adhesive.

3. An improved wall system for reducing the transmission of acoustical energy as set forth in claim 1, wherein said sound absorbing portion of said sound reducing panel comprises a porous fiber glass fiber board.

4. An improved wall system for reducing the transmission of acoustical energy as set forth in claim 1, wherein said sound absorbing portion of said sound reducing panel is a porous fiber glass fiber board having an thickness between one and two inches and having a density of approximately 6 pounds per square foot.

5. An improved wall system for reducing the transmission of acoustical energy as set forth in claim 1, wherein said sound blocking portion of said sound reducing panel comprises a non-porous sheet of mineral filled polymeric material.

6. An improved wall system for reducing the transmission of acoustical energy as set forth in claim 1, wherein said sound blocking portion of said sound reducing panel comprises a non-porous sheet of mineral filled polymeric material having a weight equal to or greater than one pound per square foot.

7. An improved wall system for reducing the transmission of acoustical energy as set forth in claim 1, wherein said sound blocking portion of said sound reducing panel comprises a non-porous sheet of mineral filled polymeric material having a thickness of approximately one-eighth of an inch and having a sound transmission coefficient greater than 25.

8. An improved wall system for reducing the transmission of acoustical energy as set forth in claim 1, wherein said inner fold member extends from an inner fold base to form an acute angle at an inner fold apex;

said outer fold member extending from an outer fold base to form an acute angle at an outer fold apex; and said inner and outer fold bases integrally formed with said inner connector and with said inner and outer fold apexes being bases integrally connected to form a fold apex.

9. A system for reducing the transmission of acoustical energy as set forth in claim 1, including a lower and an upper bracket for supporting lower and upper portions of said first and second wall surfaces of the wall.

10. An improved wall system for reducing the transmission of acoustical energy therethrough, the wall system, comprising:

A first beam and a second beam being identical to one another;

Each of said first beam and said second beam having a first flange and a second flange interconnected by an inner connector;

Said inner connector of each of said first beam and said second beam having an inner fold and an outer fold extending from said inner connector;

Each of said first beam and said second beam including said first flange and said second flange and said inner connector including said inner fold and said outer fold being a unitary metallic member;

Said first beam and said second beam being secured in a spaced apart generally parallel relationship for forming a wall support;

A first wall surface secured to said first flange of said first beam and said second beam;

A second wall surface secured to said second flange of said first beam and said second beam;

A sound reducing panel comprising a sound absorbing portion affixed to a sound blocking portion;

Said sound absorbing portion comprising a porous fiber glass fiber board having a thickness between one and two inches and having a density of approximately 6 pounds per square foot for dispersing acoustical energy for dispersing acoustical energy for dispersing sound with said sound absorbing panel;

Said sound blocking portion comprising a non-porous sheet of mineral filled polymeric material having a weight equal to or greater than one pound per square foot for blocking the transmission of acoustical energy;

Said sound reducing paneling being retained in a first pocket and a second pocket;

Said first pocket being defined between one of said inner fold and said outer fold and one of said first flange and said second flange; and Said second pocket being defined between the other of said inner fold and said outer fold and one of said first wall surface and said second wall surface for reducing the transmission of acoustical energy between said first wall surface and said second wall surface.

* * * * *